United States Patent [19]

Larrabee

[11] 4,159,130

[45] Jun. 26, 1979

[54] APPARATUS FOR STANDARDIZING TYPEWRITING MARGINS

[76] Inventor: Louise E. Larrabee, 5326 E. 33rd St., Tulsa, Okla. 74135

[21] Appl. No.: 673,280

[22] Filed: Apr. 2, 1976

[51] Int. Cl.[2] ..... B42D 15/00; B41L 3/00

[52] U.S. Cl. ..... 400/705.5; 282/29 C; 400/706; 400/522

[58] Field of Search ..... 283/1, 1 B; 282/29 C, 282/11, 9; 197/187, 188, 189; 40/159, 104.19, 124.2, 10 D; 150/39

[56] References Cited

U.S. PATENT DOCUMENTS

| | | | |
|---|---|---|---|
| 1,299,525 | 4/1919 | Wherry | 282/29 C |
| 1,679,083 | 7/1928 | Helmquist | 40/159 |
| 2,878,917 | 3/1959 | Dalboe | 197/189 |
| 3,842,506 | 10/1974 | Pascua et al. | 197/189 X |

FOREIGN PATENT DOCUMENTS

| | | | |
|---|---|---|---|
| 248389 | 6/1912 | Fed. Rep. of Germany | 282/29 C |

*Primary Examiner*—Stephen C. Pellegrino
*Attorney, Agent, or Firm*—William S. Dorman

[57] ABSTRACT

An apparatus for standardizing typewriting margins comprising a front sheet having lateral and longitudinal edges which has a window, and a back sheet attached along a seam adjacent three edges to the front sheet which leaves an opening along one edge. A leaf of paper is placed between the front and back sheets along the seam for holding the leaf in place. The window is of a certain given size such that the portion of the leaf showing through the window is the portion to be typed upon. The predetermined margins on the leaf of paper, both lateral and longitudinal, are covered by the front sheet. A scale is disposed adjacent a lateral edge to indicate the number of typewriting spaces remaining before a predetermined margin is reached. Graduations are disposed adjacent both longitudinal edges for indicating the number of lines remaining before a predetermined margin is reached.

2 Claims, 2 Drawing Figures

APPARATUS FOR STANDARDIZING TYPEWRITING MARGINS

BACKGROUND OF THE INVENTION

1. Field of the Invention

The invention relates to an apparatus for standardizing typewriting margins. More particularly the invention relates to an apparatus which prevents inadvertent typing outside of the portion of the leaf of paper upon which it is desired to type and within the predetermined margins where it is desired not to type.

2. Description of the Prior Art

Reference is made to the following U.S. patents: Anholf U.S. Pat. No. 1,587,133, "Space Guide", issued on June 1, 1926; Lancaster U.S. Pat. No. 1,503,837, "Typewriter Sheet", issued on Aug. 5, 1924; Daboe U.S. Pat. No. 2,878,917, "Typewriter Backing Sheet With Audible Warning Device", issued on Mar. 24, 1959; Ohashi U.S. Pat. No. 898,916, "Typewriter Backing Sheet", issued on Sept. 15, 1908; and Gare, U.S. Pat. No. 2,744,606, "Line Indicating Device For Typewriters", issued on May 8, 1956.

The Anholf patent shows and describes a backing sheet which is placed behind the leaf of paper to be typed upon. A graduation for dertermining a number of lines remaining before reaching the bottom of the leaf of paper is included. A scale showing the number of typing spaces remaining on a line is also included. Alternating dark and light stripes assist the operator in alignment of the leaf of paper on the backing sheet and in determining the number of lines and spaces remaining before the margins are reached.

In the Lancaster patent, various water marks are included in the leaf of paper to apprise the operator of the location of the various margins.

The Daboe patent shows and describes an audio warning device which is of interest because it includes a scale and graduation much like that of the Anholf patent. However, in Daboe the scale is folded over the top (lateral) edge of a leaf of paper prior to insertion in the typewriter by the operator, which assists the operator in aligning the leaf of paper on the backing sheet.

The Ohashi and Gare patents (Column 3, Line 17) show graduations visible to the operator along a longitudinal edge indicating the number of lines remaining to a certain point on the backing sheet (Ohashi) or envelope (Gare). Ohashi has slots in the backing sheet for insertion of the leaf of paper to be typed upon. The slots will grip and prevent the leaf of paper from moving laterally. Gare shows a folded sheet with the graduation which is formed into an pocket. A corner of the leaf of paper is inserted in the pocket with a longitudinal edge in contact with the fold of the sheet.

None of these prior constructions automatically prevented the operator from inadvertently typing within the predetermined margins of the leaf of paper. Also, the leaf of paper was not grasped and held by the prior constructions in a secure manner against both longitudinal and lateral movement in relation to the scales and graduations, or other indicating devices.

SUMMARY OF THE INVENTION

The invention is an apparatus for standardizing typewriten margins which comprises a flexible front sheet with a scale across a lateral edge thereof and a graduation along the longitudinal edges for indicating the number of typing spaces and number of lines remaining before reaching a predetermined margin, respectively. The front sheet is attached to a back sheet along a seam adjacent three edges of the front sheet leaving an opening along one edge, for example, a longitudinal edge. A leaf of paper can be inserted between the front and back sheets through the opening provided. The leaf is grasped and held by the front and back sheets along th seam where they are crowded together. The front sheet has a cut-out forming a window which corresponds to the portion of the leaf to be typed upon. The part of the leaf of paper which constitutes the predetermined margins is covered by the front sheet. Pagination slots are provided in the proper locations on the front sheet.

DETAILED DESCRIPTION OF THE PREFERRED EMBODIMENT

Figure 1:
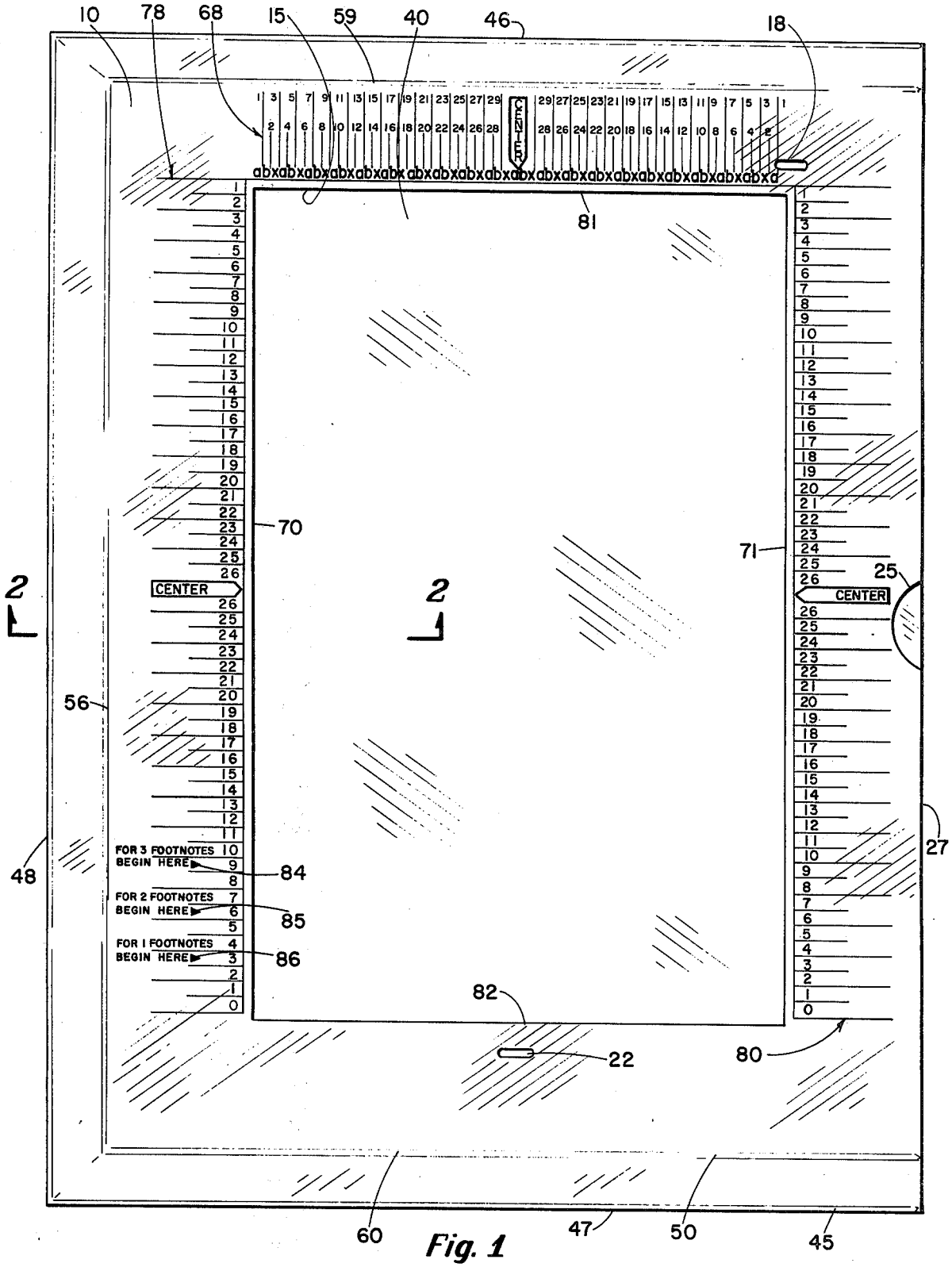
FIG. 1 is a front view of an apparatus for standardizing typewriten margins as constructed according to the present invention.

As shown in FIG. 1, the invention has a rectangular front sheet 10. The front sheet has a rectangular cutout portion which forms a window 15 (to be discussed in detail hereinafter). In addition to window 15, the front sheet has an upper pagination slot 18 above the upper right (as shown in FIG. 1) corner of window 15 and a lower pagination slot 22 which is centered below window 15 (as shown in FIG. 1). The upper pagination slot would normally be utilized only for pagination of the first page. The lower pagination slot would then be utilized, for example, for all pages following page one (as discussed above). Front sheet 10 has an indentation 25 located at the right (as shown in FIG. 1) longitudinal edge 27 of front sheet 10 (to be discussed in detail hereinafter).

A back sheet (or backing) 40 is attached to front sheet 10. The front and back sheets are made of some light, very thin, non-lumpy, non-stiff but firm, flexible, durable, mat plastic, reinforced paper, or other suitable material. The preferred material is a clear flexible plastic. If plastic is used, front sheet 10 can be attached to back sheet 40 by a standard method, for example, an outer heat seal 45 along the upper lateral edge 46 and the lower lateral edge 47 of the front sheet and along the left longitudinal edge 48 (as shown in FIG. 1) of the front sheet. A similar inner heat seal or seam 50, which is spaced toward the center of the sheets from outer seal 45, provides additional strength to the attachment of front sheet 10 to back sheet 40.

The channel 52 (FIG. 2) formed between seal 45 and seam 50 acts as a support for maintaining the rigidity of the rectangular shape of the front and back sheets and, therefore, window 15.

Figure 2:
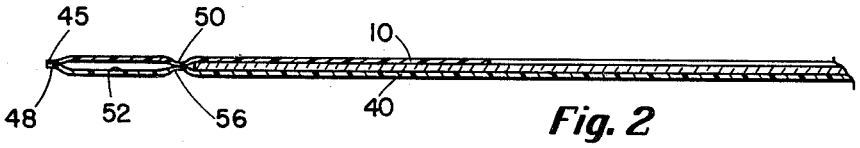
FIG. 2 is an enlarged sectional view of the apparatus taken along section line 2—2 of FIG. 1.

The area defined by seam 50 and the right longitudinal edge 27 of the front sheet is substantially the same size as the leaf of paper (not shown) to be inserted between the front and back sheets. For inserting the leaf of paper, indentation 25 allows back sheet 40 to be pulled away from front sheet 10 along the right longitudinal edge 27. The leaf of paper is inserted between the front and back sheets until the leaf of paper is engaged by the longitudinal portion 56 of seam 50. As shown in FIG. 2, front sheet 10 and back sheet 40 are crowded together along seam 50. The leaf of paper is wedged between front sheet 10 and back sheet 40 near seam 50 and is grasped and held thereby. A similar grasping and holding will occur along the lateral portions 59 (upper) and 60 (lower) of seam 50. The portion of the leaf to be typed upon shows through window 15 and the predetermined margins are covered by front sheet 10. (The size of the margins is set by the size window 15.)

A spacing scale 68 is located adjacent the upper lateral portion 59 of seam 50 and the upper lateral edge 46 of front sheet 10. The spacing scale 68 has numerals which ascend from the longitudinal edges 70 and 71 of window 15 and, therefore, the left and right predetermined margins toward the center of the lateral edge of window 15. The numerals and lines of the spacing scale would correspond to the amount of space required for a single typed letter as shown by the a, b, and x's along the bottom of scale 68. Thus, the operator is apprised of the number of spaces remaining on a line by reference to the numerals of scale 68. The numerals of scale 68 could have many different arrangements such as ascending from the right longitudinal margin to the left longitudinal margin.

Graduations 78 and 80 are located adjacent the longitudinal edges 27 and 48 of front sheet 10, respectively. Graduations 78 and 80 are similiar and are provided with numerals which ascend from the upper and lower lateral edges 81 and 82 of window 15 toward the center (and, therefore, the upper and lower predetermined margins). The graduations 78 and 80 will show the operator (for the second half of the typing upon the leaf of paper) how many lines remaining before the lower lateral edge 82 of window 15 is reached. Footnote indicators 84, 85, and 86 are provided as a part of graduation 78 on front sheet 10 to supply the operator with an indication of where to begin footnotes. The numerals of graduations 78 and 80 could, of course, ascend from the lower lateral edge 82 of window 15 to the upper lateral edge 81.

The apparatus can be constructed for any size leaf of paper, for example, legal size, letter size, etc. Any desired predetermined margin can be supplied by varying the size (and shape) of window 15. The spacing scale 68 could be scaled for any size of type, for example, pica or elite.

After placing the leaf of paper to be typed upon between the front and back sheets, the operator inserts the apparatus into a typewriter (not shown). The portion of the leaf showing through window 15 is then typed upon (and any desired pagination is made through slots 18 and 22). If the operator should inadvertently continue to type after the right longitudinal edge 71 of window 15 is reached, no typed lettering would appear on the leaf of paper because the ribbon (not shown) would impinge upon front sheet 10. If the operator should inadvertently continue to type after the lower lateral edge of window 15 is reached, no typing would appear upon the leaf of paper because the ribbon would impinge upon front sheet 10. The operator is similarly prevented from typing above or to the left of window 15. Thus, the operator is prevented from typing within the desired predetermined margins because those predetermined margins are covered by front sheet 10. If front sheet 10 is clear, any markings within the predetermined margins would, or course, be visible.

Whereas the present invention has been described in particular realtion to the drawings attached hereto, it should be understood that other and further modifications, apart from those shown or suggested herein, may be made within the spirit and scope of this invention.

What is claimed is:

1. An apparatus for standardizing typewriting margins on a leaf of paper with longitudinal and lateral edges, said leaf of paper having a portion of a given size to be typed upon and certain predetermined margins, said margins being both longitudinal and lateral and located between said edges and said portion to be typed upon comprising a flexible front sheet having a cutout of said given size for forming a window and having longitudinal and lateral edges surrounding said window, a flexible back sheet being sealed to said front sheet adjacent three edges thereof to form a seam, said back sheet extending closely adjacent and behind said front sheet for placement of said leaf between said front and back sheets with said portion of said leaf to be typed upon showing through said window and with the longitudinal and lateral edges of said front sheet covering said predetermined margins for preventing typing on said leaf of paper within said predetermined margins, said leaf being disposed between said front and said back sheet such that three edges of said leaf be closely adjacent said seam to hold said leaf securely between said sheets while maintaining said portion of said leaf to be typed upon showing through said window, said front sheet including pagination slots disposed between said window and said lateral and longitudinal edges of said front sheet.

2. Apparatus for standardizing typewriting margins as set forth in claim 1 wherein said pagination slots comprise a lower pagination slot located below said window and centered with respect to said window and an upper pagination slot located above said window and adjacent a longitudinal edge of said front sheet for pagination of said leaf of paper.

* * * * *